United States Patent [19]

Tran

[11] 4,107,617

[45] Aug. 15, 1978

[54] CONTROLLED-FREQUENCY FEEDING ARRANGEMENT FOR A LINEAR ACCELERATOR USING STATIONARY-WAVE ACCELERATING SECTIONS

[75] Inventor: Duc Tien Tran, Paris, France

[73] Assignee: CGR-MeV, Paris, France

[21] Appl. No.: 747,195

[22] Filed: Dec. 3, 1976

[30] Foreign Application Priority Data

Dec. 5, 1975 [FR] France ..... 75 37319

[51] Int. Cl.[2] ..... H05H 7/02; H05H 9/04

[52] U.S. Cl. ..... 328/233; 315/5.41

[58] Field of Search ..... 328/233–238; 315/111.6, 5.41, 5.42; 313/359

[56] References Cited

U.S. PATENT DOCUMENTS

| | | | |
|---|---|---|---|
| 3,147,396 | 9/1964 | Goertz et al. | 328/233 X |
| 3,965,434 | 6/1976 | Helgesson | 328/233 |

*Primary Examiner*—Siegfried H. Grimm

*Attorney, Agent, or Firm*—Oblon, Fisher, Spivak, McClelland & Maier

[57] ABSTRACT

A controlled-frequency arrangement for feeding a linear charged particle accelerator and enabling the power reflected by the accelerator toward the microwave generator feeding it to be minimized when the accelerator is loaded by the particle beam. The feeding arrangement comprises means for obtaining a continuous signal v of which the amplitude is proportional to the phase shift $\Delta\phi$ which may exist between the microwave signal injected into the accelerator and the signal stored in the accelerator, and for comparing this signal $v$ with a variable reference signal $v_4$ to obtain an error signal $v - v_r$ which, when applied to a frequency controlling system, causes the frequency F of the microwave generator associated with the accelerator to be suitably varied, this variation in frequency $\Delta F$ enabling the phase shift $\Delta\phi$ to be eliminated.

3 Claims, 6 Drawing Figures

Figure 1:
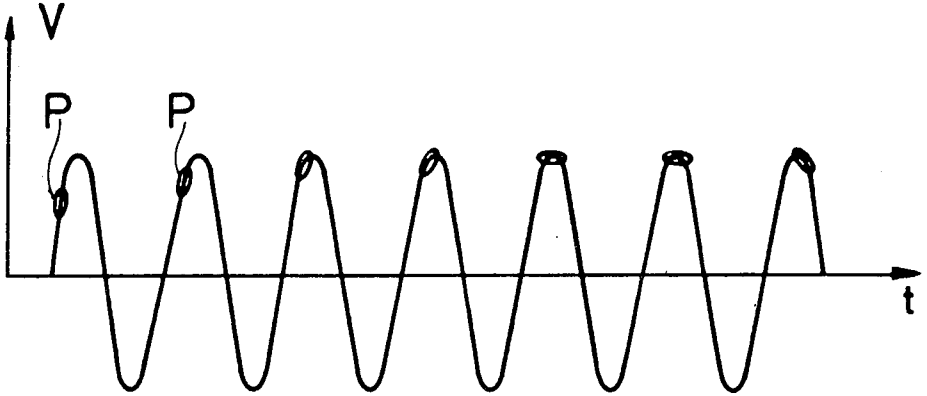

CONTROLLED-FREQUENCY FEEDING ARRANGEMENT FOR A LINEAR ACCELERATOR USING STATIONARY-WAVE ACCELERATING SECTIONS

In a linear charged-particle accelerator, the first accelerating section simultaneously performs the functions of particle "grouper" and "accelerator".

However, the particles can only be grouped during the negative phase of the high-frequency voltage corresponding to an increasing electrical field, which reduces the performance of the accelerator because this phase which is favourable to grouping is unfavourable to the acceleration process.

If the microwave source is adapted to the first accelerating section in the absence of the beam of particles so establishing a reflection-free coupling, the presence of the beam results in a misadaptation and produces a signal reflected towards the source.

By overcoupling the microwave source with the accelerating section to obtain a suitable adaptation of this accelerating section for a predetermined value of the current of the beam, it is possible to eliminate the active part of the reflected power, but the reactive part has to be dissipated into an external load, resulting in an unnecessary loss of power.

One way of eliminating this disadvantage is to shift the phase of the microwave signal injected into the accelerating section by a predetermined quantity dependent upon the characteristics of the accelerator, in particular upon the current of the beam of particles to be accelerated, to obtain a minimum reflected signal in operation.

The arrangement according to the invention enables optimum operation to be obtained for a linear charged particle accelerator, the phasing of the signals being obtained by modifying, in a predetermined manner, the operating frequency of the microwave generator associated with the accelerator.

According to the invention, a controlled-frequency arrangement for feeding a charged-particle accelerator including a particle source providing a particle beam, n stationary-wave accelerating sections constituted with resonant cavities and means for injecting a microwave signal issuing from a microwave generator into one of said accelerating sections, said arrangement comprising means for extracting a fraction $\vec{V}_1$ of said microwave signal issuing from said microwave generator and intended to be injected into the first of said n accelerating sections, means for extracting a fraction $\vec{V}_2$ of said microwave signal stored in said first accelerating section when said first accelerating section is loaded with a particle beam issued from said particle source and for phase-shifting said signal $\vec{V}_2$ by $\pi/2$ to obtain a signal $V_3$, means for obtaining a continuous signal v the amplitude of which is proportional to the phase shift $\Delta\phi$ created between said signals $\vec{V}_1$ and $\vec{V}_3$, means for comparing the signal v with a reference signal $\nu_r$ and for determining an error signal $\nu - \nu_r$ and means for monitoring the operating frequency of said microwave generator by means of said error signal $\nu - \nu_r$.

Figure 2:
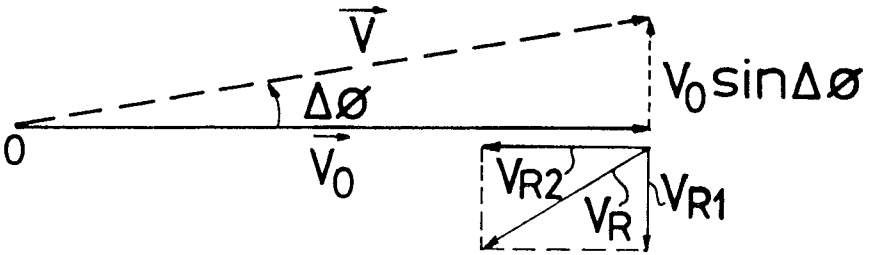

For the better understanding of the invention and to show how the same may be carried into effect, reference will be made to the drawings, given solely by way of example, which accompany the following description and wherein:

FIGS. 1 and 2 respectively illustrate, in diagrammatic form, the particle grouping process and the vector diagram showing the phase shifting of the microwave accelerating voltage in the first accelerating section, in the absence and presence of the beam of particles.

Figure 3:
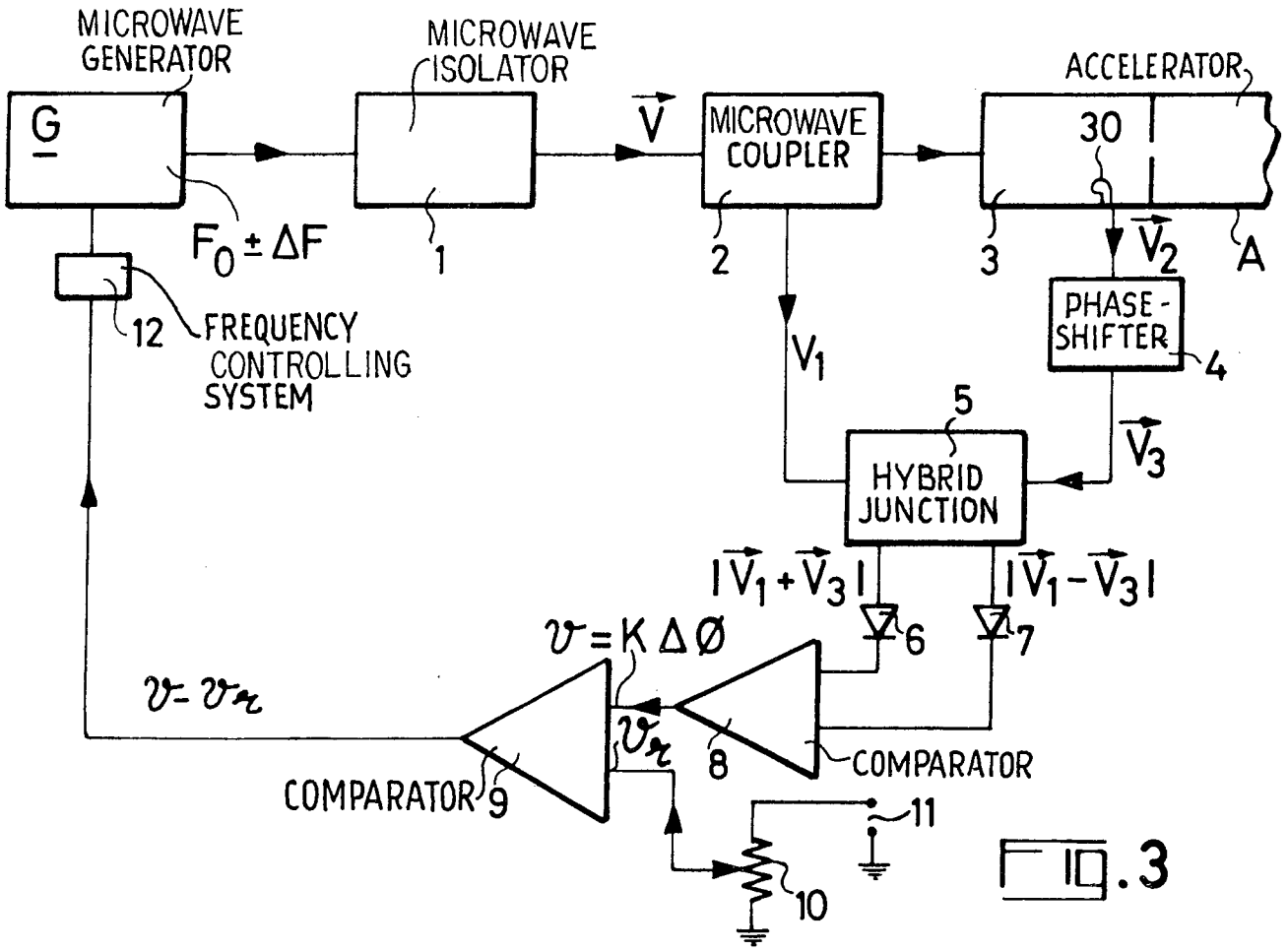

FIG. 3 shows a controlled frequency feeding arrangement according to the invention.

Figure 4:
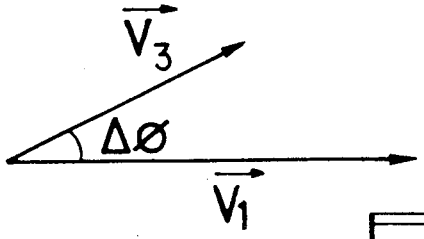
Figure 5:
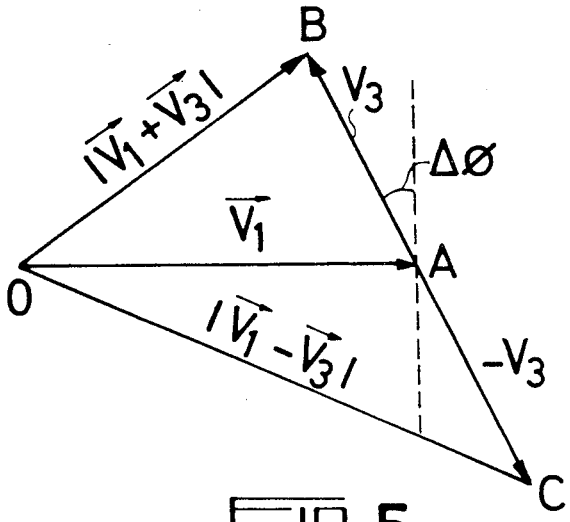

FIGS. 4 and 5 respectively show the vector diagram of the microwave signals $\vec{V}_1$ and $\vec{V}_2$ and the vector diagram determining the microwave signals obtained from the signals $\vec{V}_1$ and $\vec{V}_2$ at the output end of a hybrid junction used in the arrangement according to the invention.

Figure 6:
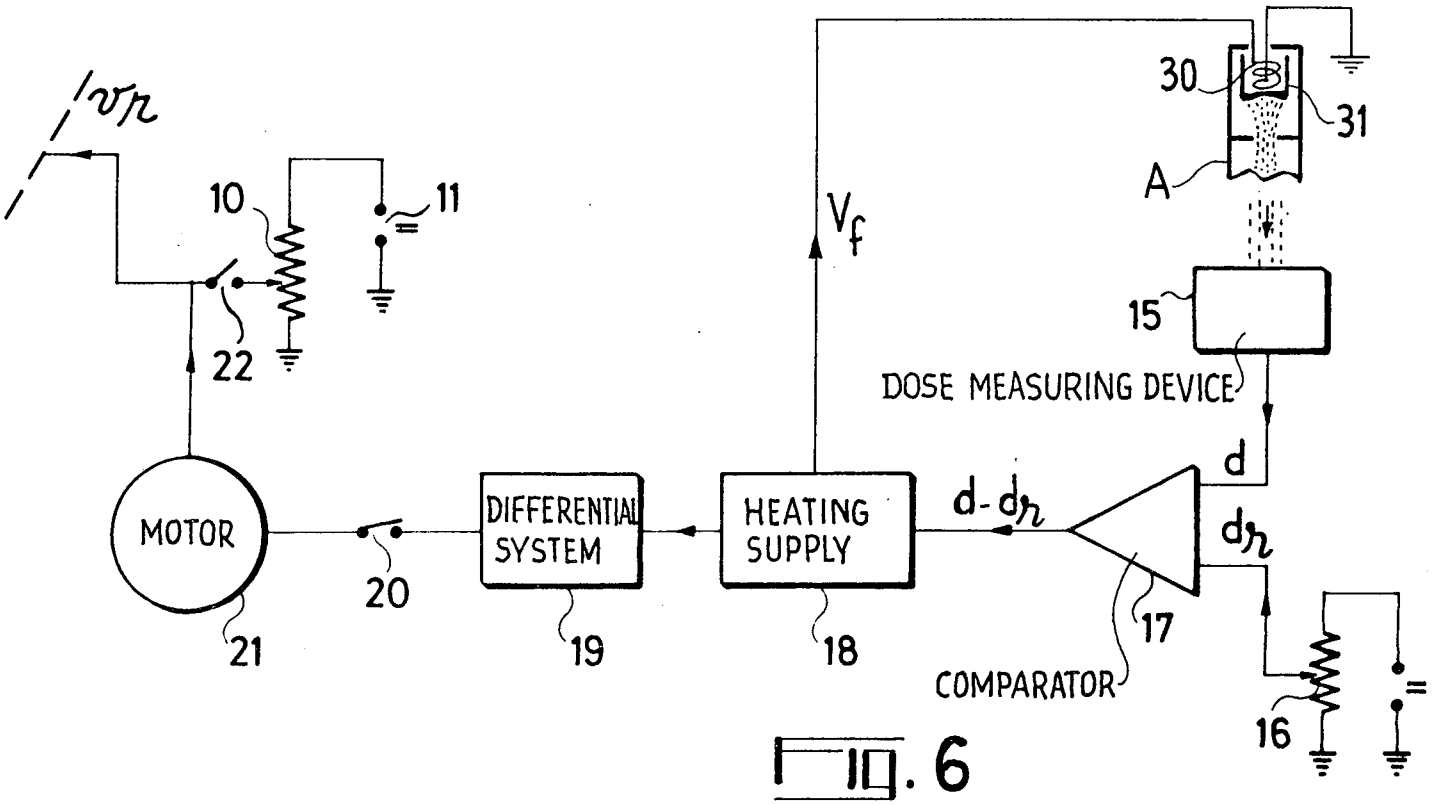

FIG. 6 shows a system for automatically monitoring the operating frequency of the microwave generator which may be used in the arrangement according to the invention.

As shown in FIG, 1, grouping P of the charged particles in the first section of a linear accelerator A which comprises n stationary-wave accelerating sections constituted with resonant cavities, takes place when the particles are situated in an increasing electrical field.

The accelerating microwave voltage created in the first accelerating section may be represented, in the absence of the beam, by a vector $\vec{V}_O$, as shown in FIG. 2. In the presence of the beam of particles, there is a phase shift between the initial microwave signal (represented by the vector $\vec{V}_O$) injected into the first accelerating section and the microwave signal prevailing in that accelerating section and represented by the vector $\vec{V}$. This phase shift produces a reflected signal $\vec{V}_R$ of which the component $\vec{V}_{R1}$, in quadrature with the initial microwave signal $\vec{V}_O$, represents the fraction of reflected reactive energy ($\vec{V}_{R1} = \vec{V}_O \sin \Delta\phi$).

In order to avoid this reflection of energy, the phase of the initial microwave signal $\vec{V}_O$ may be shifted by a value $\Delta\phi$ in such a way that the signals injected into and stored in the first accelerating section are in phase when this accelerating section is loaded by the beam.

This correcting phase shift $\Delta\phi$ may be obtained by shifting the operating frequency F of the microwave generator G associated with the accelerator A by a quantity $\Delta$ F relative to the initial frequency $F_O$ of the unloaded first accelerating section in such a way that:

$$\Delta F = F_O \Delta\phi / 2\,Q.$$

Q being the quality factor of the unloaded first accelerating section.

FIG. 3 shows a controlled frequency arrangement for feeding a particle accelerator according to the invention, this arrangement comprising a microwave generator G of which the operating frequency F is monitored by a phase comparison system. This feeding arrangement comprises, in association with the microwave generator G:

a microwave isolator 1, a microwave coupler 2 for extracting a signal-fraction $\vec{V}_1$ from the microwave signal V supplied by the generator G and delivered to the first accelerating section 3 of the accelerator A, means 30 (for example a loop or probe) for extracting a fraction $\vec{V}_2$ of the microwave energy stored in the first accelerating section 3, a phase shifter 4 for phase-shifting the signal $\vec{V}_2$ through 90° so that it becomes a microwave signal $\vec{V}_3$, a hybrid junction 5 for mixing the signals $\vec{V_1}$ and $\vec{V_3}$ to give the sum $|\vec{V_1} + \vec{V_3}|$ and the difference $|\vec{V_1} - \vec{V_3}|$ of the signals $\vec{V_1}$ and $\vec{V_3}$, two detectors 6 and 7 for supplying two signals which are proportional to the respective amplitudes A and B of the signals $|\vec{V_1} + \vec{V_3}|$ and $|\vec{V_1} - \vec{V_3}|$, a first comparator 8 for obtaining a signal v which represents the difference between the amplitudes A and B and which is proportional to the phase shift $\Delta\phi$ of the signals $\vec{V_1}$ and $\vec{V_3}$, i.e. $v = K\Delta\phi$, a second comparator 9 for comparing the signal v with an adjustable reference signal $v_r$ and for supplying an error signal $v - v_r$, a potentiometer 10 fed by a d.c. voltage source 11 for obtaining said reference signal $v_r$, a system 12 for controlling the frequency of the microwave generator G, this controlling system 12 being controlled by the signal $v - v_r$.

The vector diagram shown in FIG. 4 illustrates the vectors $\vec{V_1}$ and $\vec{V_3}$ which form an angle $\Delta\phi$ with one another, whilst the diagram of FIG. 5 illustrates how the signal $K\Delta\phi$ proportional to the phase shift $\Delta\phi$ of the vectors $\vec{V_1}$ and $\vec{V_3}$ is defined, namely:

$$OB = |\vec{V_1} + \vec{V_3}| = V_1^2 + V_3^2 - 2\cos(\pi/2 - \Delta\phi) \cdot V_1 \cdot V_3$$

$$OC = |\vec{V_1} - \vec{V_3}| = V_1^2 + V_3^2 - 2\cos(\pi/2 + \Delta\phi) \cdot V_1 \cdot V_3$$

thus:

$$OB - OC = |\vec{V_1} + \vec{V_3} - |\vec{V_1} - \vec{V_3}| = -2\,V_1 \cdot V_3 \sin\Delta\phi = K\Delta\phi.$$

In fact, the phase shift $\Delta\phi$ is dependent upon the intensity of the current of the beam of particles to be accelerated. Now, the irradiation dose is essentially determined by the intensity of the beam of particles if the microwave power delivered by the generator G and applied to the accelerator remains constant. The intensity of this beam may be controlled by controlling the heating voltage $V_F$ of the cathode of the gun of the accelerator, i.e. by controlling the power applied to the heating filament of the cathode. On the other hand, if the microwave power delivered by the generator G and the heating voltage $V_f$ of the filament of the gun of the accelerator A are fixed, the maximum irradiation dose may be controlled by suitably selecting the value of the reference signal $v_r$.

FIG. 6 shows one example of embodiment of a controlled-frequency feeding arrangement according to the invention comprising a system for controlling the maximum irradiation dose either manually or, better still, automatically. .

This automatic controlling system comprises:

a dose measuring device 15 (for example an ionisation chamber) which supplies a signal $d$ proportional to the irradiation dose, a potentiometric device 16 which supplies a signal $d_r$ corresponding to the reference dose, a comparator 17 which supplies an error signal $d - d_r$ capable of controlling a heating voltage $V_f$ furnished by a heating supply 18 for heating a filament 30 of a cathode 31 which furnishes the particle beam of the accelerator A, the variation $\Delta V_f$ in the voltage $V_f$ producing a variation in the current of the beam of particles of the accelerator A and hence the variation in the phase difference $\Delta\phi$ existing between the signals $\vec{V_1}$ and $\vec{V_3}$ defined above, a differential system 19 which supplies a signal $k\,\Delta V_f$ proportional to $\Delta V_f$, a motor 21 of which the movement, which is controlled by the signal $k\,\Delta V_f$, actuates the potentiometer 10 supplying the reference signal $v_r$ defined above, this signal $v_r$ being compared with the signal $v = K\Delta\phi$, and the difference $v - v_r$ of the signals $v$ and $v_r$ controlling the frequency controlling system 12 of the generator G (FIG. 3), two switches 20 and 22 enabling the irradiation dose to be automatically controlled (switches 20 closed and 22 open) or manually controlled (switches 20 open and 22 closed).

By using the feeding arrangement according to the invention as illustrated in FIG. 3 and provided with the dose controlling system as illustrated in FIG. 6, it is possible to obtain the minimum intensity beam capable of supplying a predetermined irradiation dose, the microwave power of the microwave generator G being previously fixed which corresponds to the optimum operational setting of the accelerator A.

For a given operational power of the accelerator A, it is possible to obtain the setting of the frequency F of the generator G which corresponds to the maximum irradiation dose by acting on the potentiometer 16. So, the use of the microwave feeding arrangement according to the invention enables the performance of linear accelerators to be considerably improved. Such a feeding arrangement is particularly advantageous when it is associated with the accelerator of a radio-therapy apparatus.

What I claim is:

1. A controlled-frequency feeding arrangement for feeding a charged-particle accelerator, said accelerator including a particle source providing a particle beam, n stationary-wave accelerating sections constituted with resonant cavities and means for injecting a microwave signal $\vec{V_O}$ issuing from a microwave generator G into one of said accelerating sections, said microwave arrangement comprising means for extracting a fraction $\vec{V_1}$ of said microwave signal $\vec{V_0}$ issuing from said microwave generator and intended to be injected into the first of said n accelerating sections, means for extracting a fraction $\vec{V_2}$ of the microwave signal stored in said first accelerating section loaded with said beam of particles and for phase-shifting said signal $\vec{V_2}$ by $\pi/2$ to obtain a signal $\vec{V_3}$, means for obtaining a continuous signal $v$ of which the amplitude is proportional to the phase shift $\Delta\phi$ created between the microwave signals $\vec{V_1}$ and $\vec{V_3}$, means for comparing the signal $v$ with a reference signal $v_r$ and for determining an error signal $v - v_r$ and means for controlling the operating frequency of said microwave generator by means of said error signal $v - v_r$.

2. A controlled frequency feeding arrangement as in claim 1, wherein said means for extracting the microwave signal $\vec{V_1}$ comprises: a microwave isolator and a microwave coupler connected in series between the output of said microwave generator and said first accelerating section, with the signal $\vec{V_1}$ being obtained from an output of said microwave coupler;

said means for extracting said signal $\vec{V_2}$ comprising a coupling loop in said first accelerating section, a phase shifter connected to said coupling loop for phase-shifting said signal $\vec{V_2}$ by $\pi/2$ to give said signal $\vec{V_3}$, a hybrid junction connected to said coupler and to said phase shifter for mixing said signals $\vec{V}_1$ and $\vec{V}_3$ and obtaining signals $|\vec{V}_1 + \vec{V}_3|$ and $|\vec{V}_1 - \vec{V}_3|$, two detectors connected to the respective outputs of said hybrid junction for supplying two signals which are proportional to the respective amplitudes of the signals $|\vec{V}_1 + \vec{V}_3|$ and $|V_1 - V_3|$, a first comparator connected to the outputs of said two detectors for giving a continuous signal v corresponding to the difference in amplitude of the signals $|\vec{V}_1 + \vec{V}_3|$ and $|\vec{V}_1 - \vec{V}_3|$, this signal $v$ being proportional to the phase shift $\Delta\phi$ of the signals $\vec{V}_1$ and $\vec{V}_3$, a second comparator for comparing the signal $v$ with an adjustable reference signal $v_r$ and for supplying an error signal $v - v_r$, said signal $v_r$ being supplied by means of a d.c. voltage source associated with a potentiometer, a frequency controlling system for controlling the frequency of said microwave generator G, said system being controlled by said error signal $v - v_r$.

3. A controlled-frequency feeding arrangement as claimed in claim 2, said feeding arrangement being associated with an irradiation dose controlling system, said irradiation dose being related to the particle beam intensity, said system for controlling the irradiation dose controlling said potentiometer.

* * * * *